US010020603B1

(12) United States Patent
Liu et al.

(10) Patent No.: US 10,020,603 B1
(45) Date of Patent: Jul. 10, 2018

(54) FINE PITCH HIGH DENSITY HIGH-SPEED ORTHOGONAL CARD EDGE CONNECTOR

(71) Applicant: Amphenol Commercial Products (ChengDu) Co. LTD, Chengdu (CN)

(72) Inventors: Yunxiang Liu, Chengdu (CN); Zhineng Fan, Sugar Land, TX (US); Lei Liao, Shenzhen (CN); Yaohua Hou, Chengdu (CN); Luyun Yi, Chengdu (CN)

(73) Assignee: Amphenol Commercial Products (ChengDu) Co. LTD, Chengdu (CN)

( * ) Notice: Subject to any disclaimer, the term of this patent is extended or adjusted under 35 U.S.C. 154(b) by 0 days.

(21) Appl. No.: 15/680,238

(22) Filed: Aug. 18, 2017

(30) Foreign Application Priority Data

Mar. 31, 2017 (CN) ..... 2017 2 0328266 U

(51) Int. Cl.
*H01R 12/70* (2011.01)
*H01R 12/72* (2011.01)
*H01R 12/73* (2011.01)

(52) U.S. Cl.
CPC ..... *H01R 12/7088* (2013.01); *H01R 12/707* (2013.01); *H01R 12/7023* (2013.01); *H01R 12/7064* (2013.01); *H01R 12/7082* (2013.01); *H01R 12/721* (2013.01); *H01R 12/725* (2013.01); *H01R 12/732* (2013.01); *H01R 12/737* (2013.01)

(58) Field of Classification Search
CPC .. H01R 13/6658; H01R 13/514; H01R 13/64; H01R 13/6456; H01R 13/65807; H01R 23/7073; H01R 23/7068; H01R 23/688
USPC ..... 439/76.1, 79, 607.06, 607.07, 680
See application file for complete search history.

(56) References Cited

U.S. PATENT DOCUMENTS 6,638,110 B1 * 10/2003 Billman ..... H01R 13/514 439/108
6,652,318 B1 * 11/2003 Winings ..... H01R 13/6471 439/607.07
6,666,692 B2 * 12/2003 Billman ..... H01R 13/514 439/76.1
6,682,369 B1 * 1/2004 Korsunsky ..... H01R 13/6585 439/607.07
6,884,117 B2 * 4/2005 Korsunsky ..... H01R 13/6585 439/607.11
7,862,376 B2 * 1/2011 Sypolt ..... H01R 13/6587 439/607.07
8,702,454 B2 * 4/2014 Hamada ..... H01R 13/04 439/733.1

(Continued)

*Primary Examiner* — Gary Paumen
(74) *Attorney, Agent, or Firm* — Gokalp Bayramoglu

(57) ABSTRACT

A fine pitch high density high-speed orthogonal card edge connector includes at least one signal transmission assembly which includes a plug-in connector, a press-fit connector, and a PCB board. A side of the PCB board is provided with a row of first pads, and a side of the PCB board adjacent to the side where the first pads are located is provided with a row of second pads. Each first pad corresponds to one second pad one by one through the wiring of the PCB board. An extension line of each first pad is perpendicular to an extension line of each second pad. The plug-in connector is mounted on the side of the PCB board provided with the first pads and is connected to the first pads. The press-fit connector is mounted on the side of the PCB board provided with the second pads and is connected to the second pads.

13 Claims, 9 Drawing Sheets

(56) References Cited

U.S. PATENT DOCUMENTS

| | | | | |
|---|---|---|---|---|
| 2004/0235352 | A1* | 11/2004 | Takemasa | H01R 12/52 439/607.07 |
| 2005/0032430 | A1* | 2/2005 | Otsu | H01R 13/6587 439/607.07 |
| 2006/0014433 | A1* | 1/2006 | Consoli | H01R 13/6485 439/607.07 |
| 2006/0094267 | A1* | 5/2006 | Li | H01R 13/6658 439/76.1 |
| 2009/0191727 | A1* | 7/2009 | Pan | H01R 13/514 439/76.1 |
| 2013/0217263 | A1* | 8/2013 | Pan | H01R 13/6474 439/607.07 |

* cited by examiner

FINE PITCH HIGH DENSITY HIGH-SPEED ORTHOGONAL CARD EDGE CONNECTOR

CROSS REFERENCES TO RELATED APPLICATION

This application is based upon and claims priority to Chinese Patent Application No. CN 201720328266.8, filed on Mar. 31, 2017, the entire contents of which are incorporated herein by reference.

TECHNICAL FIELD

The present invention relates to signal/power transmission devices, and more particularly to a fine pitch high density high-speed orthogonal card edge connector.

BACKGROUND OF THE INVENTION

Connectors are key component in signal transmission. With the rapid development of communication technology, the connectors have been developed in a continuing trend of miniaturization, multi-pin, and small-spacing in order to achieve a high-speed transmission of signal. Within a limited space in the current connector in the art, the component in the current connector responsible for switching the signal includes a plurality of substrates and a plurality of irregular and long terminals arranged on each substrate. A separate housing is further required to encapsulate each substrate and the terminals provided thereon. In addition, a structure for electromagnetic shielding is provided between the adjacent encapsulation housings. Thus, the entire connector has a complex structure, a complicated design, and a difficult manufacturing process. Moreover, the transmission rate of the electrical connector is hard to improve.

SUMMARY OF THE INVENTION

In view of the above drawbacks in the prior art, a fine pitch high density high-speed orthogonal card edge connector provided by the present invention solves the problem where the structure of the switching member which switches the signal in the existing connector is complex.

In order to achieve the above objects, the technical solution used in the present invention is as follows.

A fine pitch high density high-speed orthogonal card edge connector includes at least one signal transmission assembly. The signal transmission assembly includes a plug-in connector, a press-fit connector, and a PCB board. A side of the PCB board is provided with a row of first pads, and a side of the PCB board adjacent to the side where the first pads are located is provided with a row of second pads. Each first pad corresponds to one second pad one by one through the wiring of the PCB board. An extension line of each first pad is perpendicular to an extension line of each second pad. The plug-in connector is mounted on the side of the PCB board provided with the first pads and is connected to the first pads. The press-fit connector is mounted on the side of the PCB board provided with the second pads and is connected to the second pads.

Furthermore, the fine pitch high density high-speed orthogonal card edge connector further includes a base. The base is provided with accommodating grooves for mounting the signal transmission assemblies. The number of the accommodating grooves is the same number as the number of the signal transmission assemblies. Each signal transmission assembly is provided with a mounting housing for encapsulating the signal transmission assembly.

Furthermore, each bar-shaped groove located on each end of the plug-in connector and the press-fit connector is provided with convex ribs. The convex ribs contact both surfaces of the PCB board. A scrap holding groove is provided under the convex ribs.

Furthermore, the plug-in connector includes a plug-in housing and a terminal assembly. The terminal assembly is mounted in an assembly snapping-on groove inside the plug-in housing and extends out of the assembly snapping-on groove to contact the first pads of the PCB board. The terminal assembly includes two rows of terminals and a connecting plate formed on the two rows of terminals. The connecting plate is formed by injection molding.

Furthermore, each row of terminals includes a plurality of first terminals and at least one second terminal which is used for hot-swapping. The length of the second terminal is greater than the length of the first terminal.

Furthermore, both ends of the assembly snapping-on groove are provided with a projecting portion. The projecting portion is inclined upward and extends toward the middle portion of the assembly snapping-on groove. Both ends of the connecting plate are provided with a snapping-on groove which fits the projecting portion.

Furthermore, a positioning key is arranged in a width direction of the connecting plate. A metal cap is snapped on a lower end of the positioning key. The side of the PCB board where the first pads are located is provided with an arcuate groove which fits the positioning key.

Furthermore, the press-fit connector includes a terminal housing. The terminal housing is provided with a bar-shaped mounting groove. A sidewall of the mounting groove is provided with a row of terminal inserting slots along the length direction. A plurality of third terminals are snapped in a row of terminal inserting slots, and a plurality of fourth terminals are snapped in another row of terminal inserting slots. The fourth terminal has a different structure than that of the third terminal.

Furthermore, each of the third terminal and the fourth terminal includes a curved portion, a planar connecting plate and a press-in portion that are connected as a whole. The width of a portion of the planar connecting plate of the third terminal adjacent to the curved portion thereon is equal to the width of the curved portion. The width of another portion of the planar connecting plate of the third terminal away from the curved portion thereon is greater than the width of the curved portion. The width of the planar connecting plate of the fourth terminal is greater than the width of the curved portion thereon. At least one mounting hole is formed in the planar connecting plate.

Furthermore, an end of the terminal housing is provided with an extension portion. The extension portion is provided with an inserting groove for snapping on the PCB board.

The beneficial effects of the present invention are as follows. The present invention replaces the existing connectors which are hard to be manufactured by means of a plug-in connector, a press-fit connector, and a PCB board which are easy to be manufactured. Thus, the difficulty of manufacturing the fine pitch high density high-speed orthogonal card edge connector is reduced.

In addition, the existing slender terminals are replaced by the conductive first pads and second pads on the PCB board. Thus, when the wiring of first pads and second pads is connected, it is only required to ensure the one-by-one correspondence between the first pads and the second pads. There is no need to consider what kind of specific structure should be applied to similar terminals. Therefore, the present invention has the advantage of flexible multi-layer wiring. It is easy to design a high-speed orthogonal electrical connector.

Figure 1:
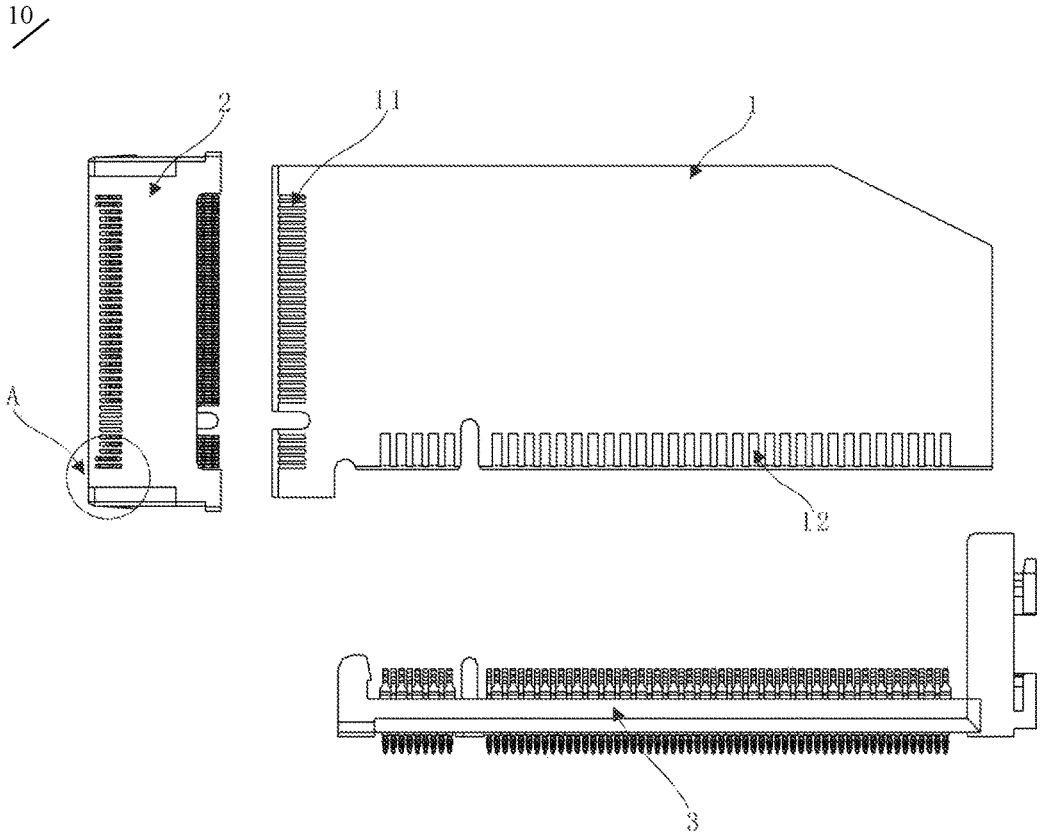
FIG. 1 is a schematic diagram of the assembly process of the plug-in connector, press-fit connector, and PCB board.

In the drawings: 1. PCB board; 11. first pad; 12. second pad; 2. plug-in connector; 21. plug-in housing; 211. convex rib; 212. scrap holding groove; 213. projecting portion; 214. window; 22. terminal assembly; 221. positioning key; 222. first terminal; 223. second terminal; 224. connecting plate; 2241. snapping-on groove; 23. metal cap; 3. press-fit connector 31. terminal housing; 311. extension portion; 312. convex block; 32. third terminal; 321. curved portion; 322. planar connecting plate; 323. press-in portion; 33. fourth terminal; 4. mounting housing; 41. snapping-on plate; 411. arcuate groove; 42. arcuate projection; 5. base; 51. accommodating groove; 52. connecting portion; 53. positioning pillar.

DETAILED DESCRIPTION OF THE INVENTION

The embodiments of the present invention will be described in detail hereinafter, so that those skilled in the art would understand the present invention. However, it should be understood that the present invention is not limited to the scope of the specific embodiments. For those of ordinary skill in the art, the variations would be obvious if various changes fall within the spirit and scope determined and defined by the appended claims of the present invention. All inventions using the inventive concept of the present invention fall within the protective scope.

With reference to FIG. 1, a schematic diagram of the assembly process of the plug-in connector, press-fit connector, and PCB board is illustrated. As shown in FIG. 1, the fine pitch high density high-speed orthogonal card edge connector includes at least one signal transmission assembly 10. A user can assemble a plurality of signal transmission assemblies of the present invention together to form a combined connector to transmit more signal depending on where the present invention is used. Therefore, the present invention can be used in a variety of places.

As shown in FIG. 1, the signal transmission assembly includes a plug-in connector 2, a press-fit connector 3, and a PCB board 1. When the user is connecting two circuit boards to each other, the user only needs to press the terminals of press-fit connector 3 into the mounting holes on the circuit board and insert the other circuit board into the terminals of the plug-in connector 2, such that the connection between the two circuit boards can be achieved. The installation is very convenient.

A side of the PCB board 1 is provided with a row of first pads 11. The side of the PCB board 1 adjacent to the side where the row of first pads 11 is located is provided with a row of second pads 12. Each first pad 11 corresponds to one second pad 12 one by one through the wiring of the PCB board. An extension line of each first pad 11 is perpendicular to an extension line of each second pad 12. Plug-in connector 2 is mounted on the side of the PCB board 1 provided with the row of first pads 11 and is connected to the row of first pads 11. The press-fit connector 3 is mounted on the side of the PCB board 1 provided with the row of second pads 12 and is connected to the row of second pads 12.

To ensure effective signal transmission between plug-in connector 2 and first pads 11 and effective signal transmission between press-fit connector 3 and second pads 12, first pad 11 and second pad 12 are both configured as contacts with a certain length. Moreover, plug-in connector 2 and press-fit connector 3 can be fixedly mounted on PCB board 1 by welding. Alternatively, plug-in connector 2 and press-fit connector 3 can also clamp PCB board 1 tightly through the clamping pressure generated by the terminals thereon.

In one embodiment of the present invention, the fine pitch high density high-speed orthogonal card edge connector further includes base 5. Base 5 is provided with a plurality of accommodating grooves 51 for mounting the signal transmission assemblies. The number of accommodating grooves 51 is the same as that of the signal transmission assemblies. Each signal transmission assembly is provided with a mounting housing 4 for encapsulating the signal transmission assembly. The structure of the connector provided with base 5 and mounting housing 4 is shown in FIGS. 3 and 4.

Figure 3:
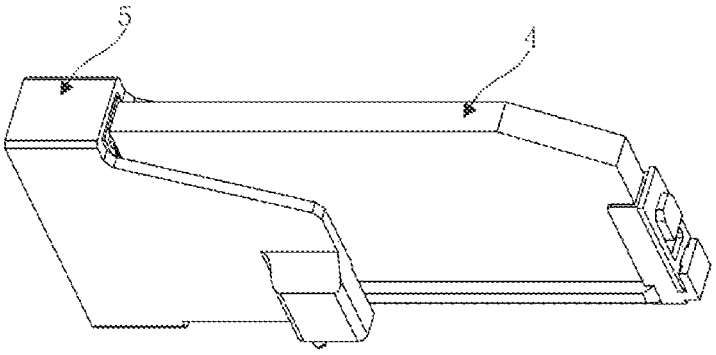
FIG. 3 is a perspective view of the fine pitch high density high-speed orthogonal card edge connector with one signal transmission assembly.
Figure 4:
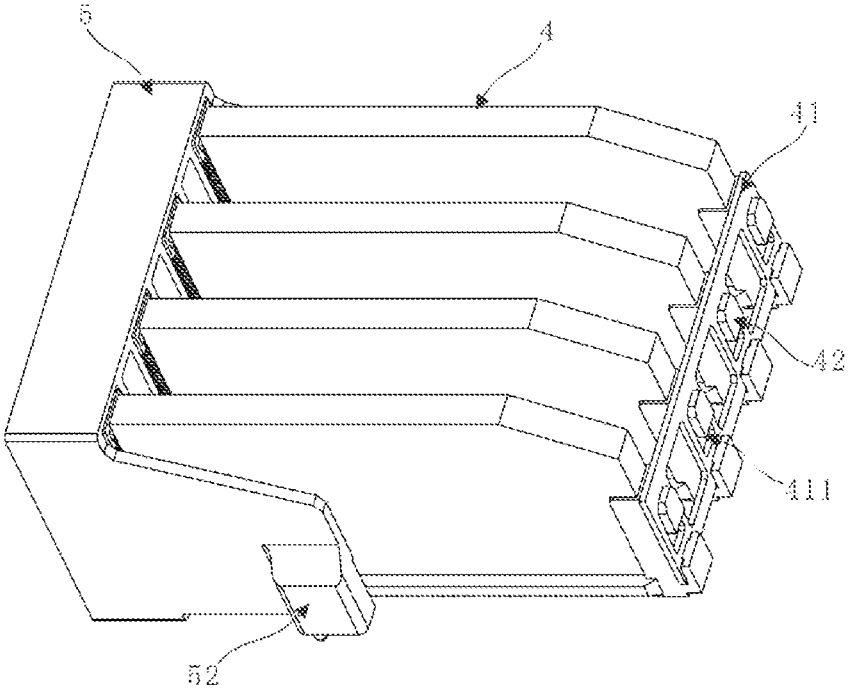
FIG. 4 is a perspective view of the fine pitch high density high-speed orthogonal card edge connector with a plurality of signal transmission assemblies.

As shown in FIGS. 3 and 4, base 5 includes a base body provided with accommodating groove 51 and extension arms provided on both sides of the base body. Each extension arm has a shape of a right-angled trapezoid. Accommodating groove 51 passes through the entire base body so that the terminals of plug-in connector 2 can pass through accommodating groove 51 to realize the snapping-on connection of the circuit board.

Figure 5:
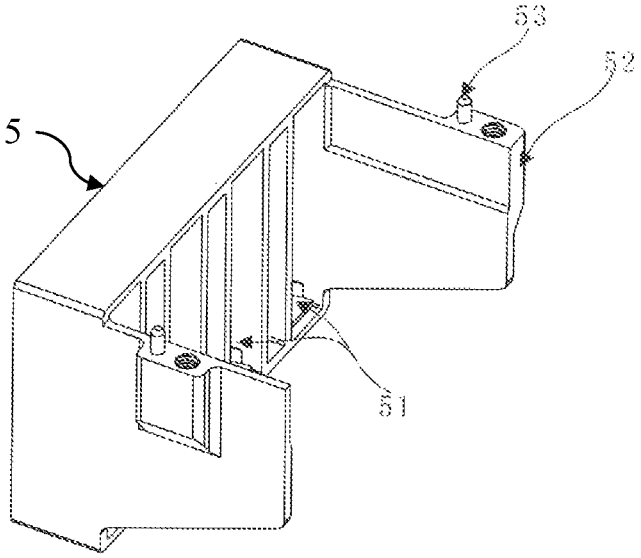
FIG. 5 is a perspective view of the base with a plurality of accommodating grooves.

As shown in FIG. 5, connecting portion 52 with a certain thickness is fixedly mounted on the free end of the extension arm (the base body, the extension arm, and connecting portion 52 can be a structure formed integrally). An end surface of connecting portion 52 adjacent to press-in connector 3 is provided with positioning pillar 53 and screw holes.

When the two circuit boards need to communicate with each other, positioning pillar 53 can be used for positioning and guiding press-in connector 3 to be pressed to the circuit boards. The fine pitch high density high-speed orthogonal card edge connector can be stably fixed to the circuit board through the fitting between the screw hole and the screw.

When a plurality of signal transmission assemblies is used in the present invention, in order to ensure the stability of the plurality of signal transmission assemblies assembled together, a snapping-on plate could be provided on an end surface of mounting housing 4 away from the plug-in connector 2 to fix the plurality of signal transmission assemblies together.

Figure 6:
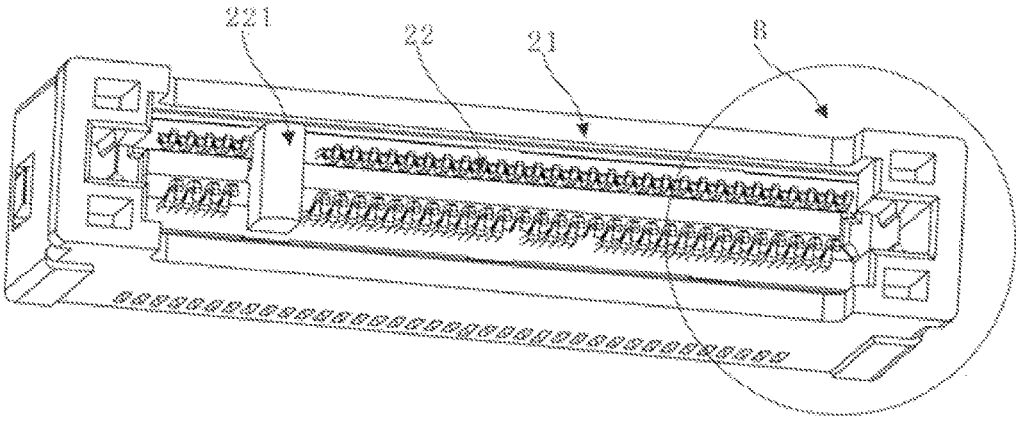
FIG. 6 is a perspective view of the plug-in connector from one perspective.
Figure 7:
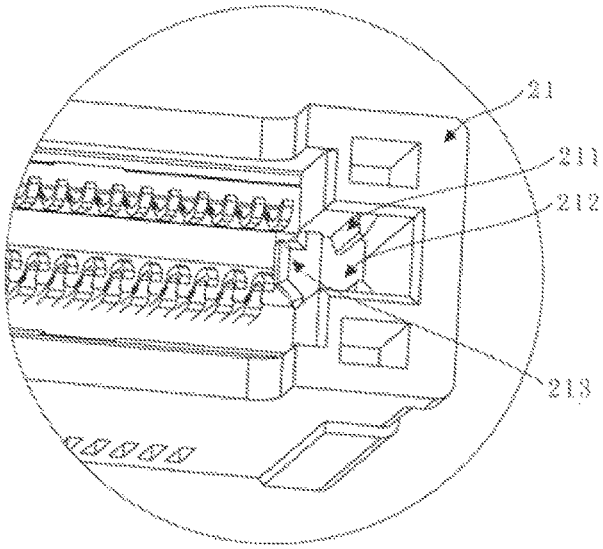
FIG. 7 is an enlarged view of the portion B in FIG. 6.
Figure 13:
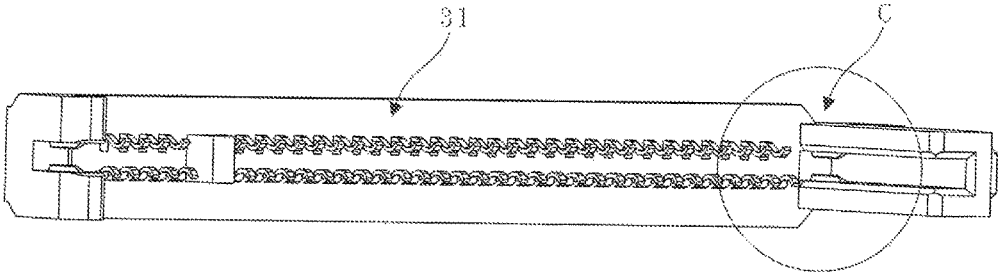
FIG. 13 is a perspective view of the press-in connector from another perspective.
Figure 14:
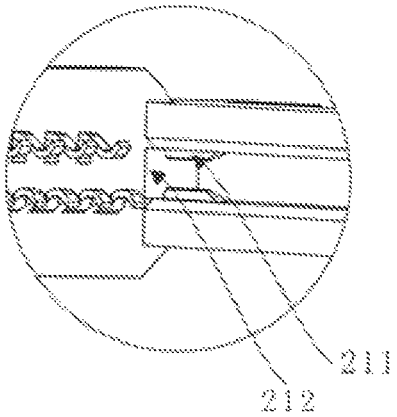
FIG. 14 is an enlarged view of the portion C in FIG. 12.

As shown in FIGS. 6, 7, 13, preferably, each bar-shaped groove located on both ends of the plug-in connector 2 and the press-fit connector 3 is provided with a plurality of convex ribs 211. The plurality of convex ribs 211 contact both sides of the PCB board 1. Scrap holding groove 212 is provided below the convex ribs 211. (Preferably, scrap holding groove 212 is provided immediately adjacent to the bottom of convex rib 211)

Since convex ribs 211 are provided, the stability of the connection between PCB board 1, plug-in connector 2, and press-fit connector 3 can be reinforced. When PCB board 1, plug-in connector 2, and press-fit connector 3 are fixed together by welding, convex ribs 211 can also prevent the external force from directly acting on the solder joint.

Since scrap holding groove 212 is added below convex ribs 211, the scraps produced when PCB board 1 contacts convex ribs 211 of plug-in connector 2 and press-fit connector 3 can fall into scrap holding groove 212. Thus, when PCB board 1 is connected to plug-in connector 2 and press-fit connector 3, an incomplete assembling caused by scraps can be avoided. Also, the following problem can be avoided, i.e., the signal transmission between first pads 11 and plug-in connector 2 and the signal transmission between second pads 12 and press-fit connector 3 are affected by the incomplete assembling.

As shown in FIGS. 6 to 9, plug-in connector 2 includes plug-in housing 21 and terminal assembly 22. Terminal assembly 22 is mounted in assembly snapping-on groove 215 of plug-in housing 21 and extends out of assembly snapping-on groove 215 to contact first pads 11 of PCB board 1. Terminal assembly 22 includes two rows of terminals and connecting plate 224 formed on the two rows of terminals. Connecting plate 224 is formed by injection molding.

Since connecting plate 224, by which all the terminals are assembled together, is formed on the two rows of terminals by injection molding, it is unnecessary to provide a slender slot on the sidewall of assembly snapping-on groove 215 of plug-in housing 21 for mounting a single terminal, such that the difficulty of processing plug-in housing 21 is reduced. Moreover, the terminals are prevented from being fit into plug-in housing 21 one by one, thereby shortening the assembling time and reducing the difficulty of assembling.

In one embodiment of the present invention, each row of terminals of plug-in connector 2 includes a plurality of first terminals 222 and at least one second terminal 223 for the hot-swapping. The length of the second terminal 223 is greater than the length of the first terminal 222, specifically referring to FIGS. 2 and 8.

In practice, preferably, the space between the adjacent two first terminals 222 located in the same row of plug-in connector 2 is ranged from 0.5 mm to 0.65 mm, wherein the end points of 0.5 mm and 0.65 mm are included. With the design of such size, the overall length of plug-in connector 2 can be greatly reduced, thereby reducing the mounting space of the orthogonal backplane connector.

In addition, the opposing terminals in the two rows of terminals of plug-in connector 2 are arranged in a staggered manner. With such arrangement, when the space between two adjacent first terminals 222 is reduced, the opposing terminals 222 can be staggered with a certain distance to avoid the problem of signal crosstalk interference.

Since the hot swapping structure is directly arranged on the small-spacing high-speed orthogonal connector, regardless of whether the circuit board to be inserted into the connector is provided with the hot swapping structure, the connector provided by the present solution can achieve the function of hot swapping. Thus, the versatility and usage scope of the connector of the present solution can be ensured.

With second terminals 223 which has a length greater than that of first terminals 222 as the hot swapping structure, the process of manufacturing the connector to achieve the hot swapping function is simplified, and the feasibility of enabling hot swapping through the connector is ensured.

The principle for implementing the hot swapping of the present solution is as follows. When the PCB board is inserted, the power supply is preloaded to the system through the long pins. An instruction is sent to the system for the system to get ready for the formal operation. Moreover, when the PCB board is pulled out, as the short pins are detached, an instruction is sent to the system for the system to get ready to shut down. Thus, the operation without shutting down the system or cutting off the power supply is achieved. The damage to the inserted circuit board and loss of data can be avoided.

Figure 9:
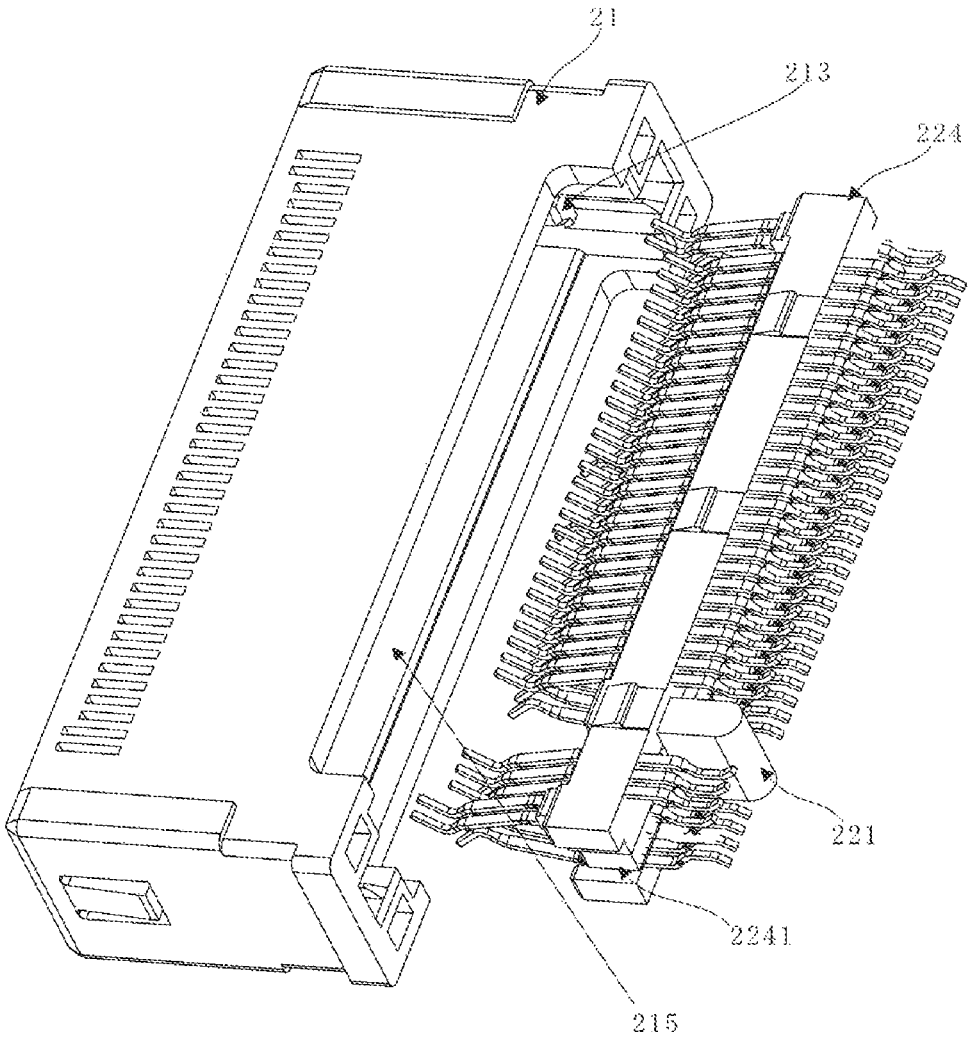
FIG. 9 is a schematic diagram showing that a terminal assembly fits into the plug-in housing.

As shown in FIGS. 7 and 9, in practice, preferably, both ends of assembly snapping-on groove 215 are provided with projecting portion 213 which is inclined upward and extends toward the middle portion of assembly snapping-on groove 215. Both ends of connecting plate 224 are provided with snapping-on groove 2241 which fits projecting portion 213.

Furthermore, the bar-shaped groove is connected to assembly snapping-on groove 215. Preferably, projecting portion 213 is provided on the sidewall of assembly snapping-on groove 215 adjacent to the bar-shaped groove. The side surface that projecting portion 213 which fits snapping-on groove 2241 is inclined with respect to the bottom surface of projecting portion 213. Namely, since the inclined plane is provided, projecting portion 213 has a structure with a wide bottom surface and a narrow top surface.

Since snapping-on groove 2241 and projecting portion 213 are provided, when terminal assembly 22 is fit into snapping-on groove 215, if the worker accidentally inserts terminal assembly 22 reversely, terminal assembly 22 cannot enter. Thus, the plug-in connector 2 is prevented from being damaged due to an insertion with incorrect direction.

Figure 2:
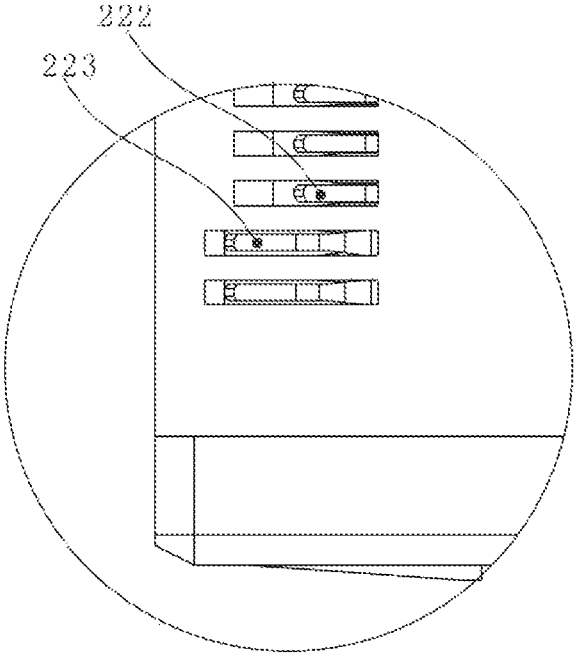
FIG. 2 is an enlarged view of the portion A in FIG. 1.
Figure 8:
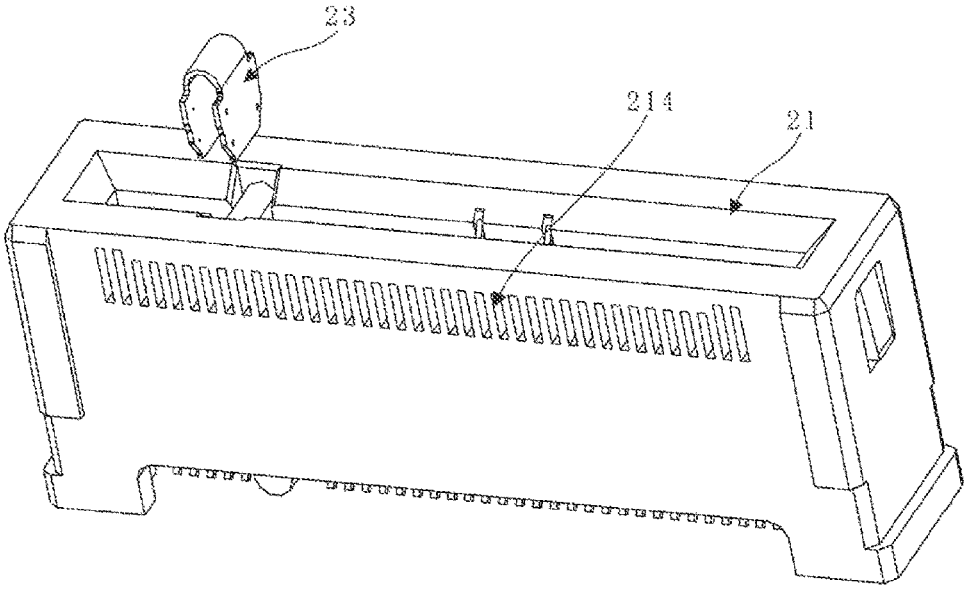
FIG. 8 is a schematic diagram showing that a metal cap is snapped in the plug-in connector.

As shown in FIGS. 2, 8 and 9, a plurality of windows 214 is arranged on the sidewall of plug-in housing 21 in the length direction. Windows 214 are used to observe the situation whether first terminal 222 and second terminal 223 of terminal assembly 22 are assembled in place. Preferably, the number of windows 214 corresponds to the number of first terminal 222 and second terminal 223 one by one. The arrangement of windows not only facilitates the observing of the assembly situation of each of first terminals 222 and second terminals 223, but also can be used as the heat dissipation passage to ensure that the heat generated by first terminal 222 and second terminal 223 can be quickly diffused, thereby ensuring the transmission rate of the signal and the lifetime of first terminal 222 and second terminal 223.

As shown in FIGS. 6, 8 and 9, positioning key 221 is arranged on connecting plate 224 in the width direction. Metal cap 23 is snapped on a lower end of positioning key 221. The side of PCB board 1 where first pads 11 are located is provided with an arcuate groove which fits positioning key 221. The introduction of metal cap 23 improves the plugging lifetime of plug-in connector 2 and the circuit board, such that the plug-in connector 2 can withstand repeated plugging.

As shown in FIGS. 10 to 14, press-fit connector 3 includes terminal housing 31. Terminal housing 31 is provided with a bar-shaped mounting groove. The sidewall of the mounting groove is provided with a row of terminal inserting slots along the length direction. Moreover, third terminals 32 are snapped in one row of terminal inserting slots. Fourth terminals 33 are snapped in another row of terminal inserting slots. Fourth terminals 33 has a different structure than that of third terminal 32. To simplify the structure of the sides of PCB board 1 where first pads 11 and second pads 12 are located, in practice, the bar-shaped groove of press-fit connector 3 is connected to the mounting groove.

Figure 11:
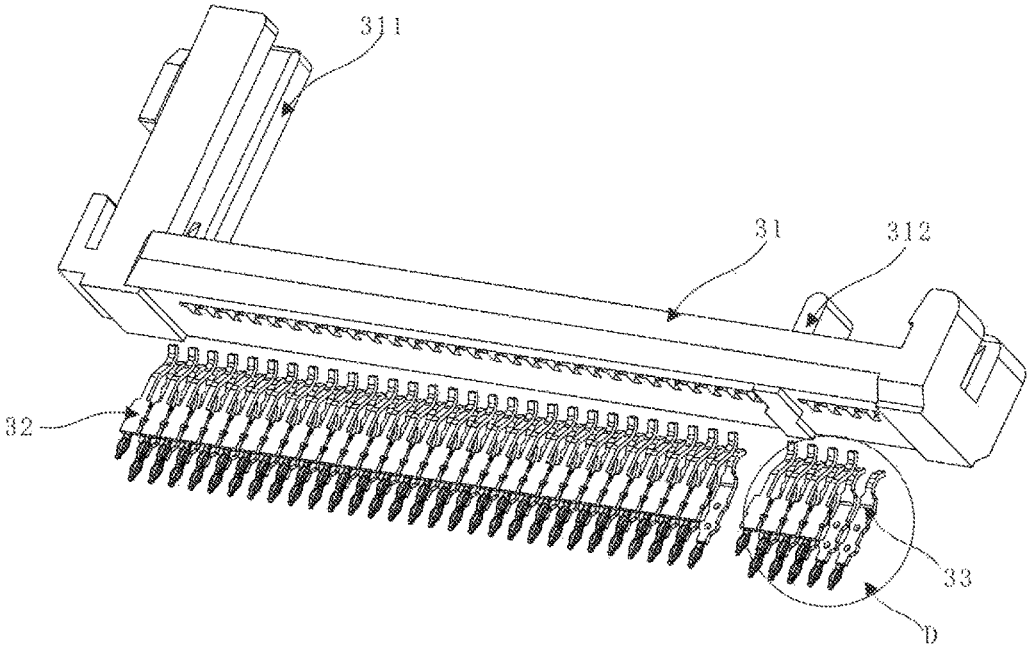
FIG. 11 is a schematic view showing that the third terminal and the fourth terminal fit into the plug-in housing.
Figure 12:
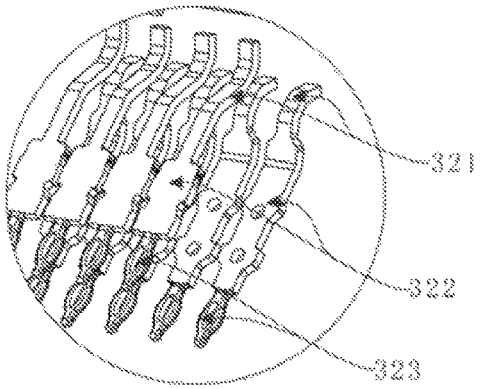
FIG. 12 is an enlarged view of the portion D in FIG. 11.

As shown in FIGS. 11 and 12, in one embodiment of the present invention, each of third terminal 32 and fourth terminal 33 includes curved portion 321, planar connecting plate 322, and press-in portion 323 that are connected as a whole. The width of a portion of planar connecting plate 322 of third terminal 32 adjacent to curved portion 321 thereon is equal to the width of curved portion 321. The width of another portion of planar connecting plate 322 of third terminal 32 away from curved portion 321 thereon is greater than the width of curved portion 321. The width of planar connecting plate 322 of fourth terminal 33 is greater than the width of curved portion 321 thereon. At least one mounting hole is formed in planar connecting plate 322.

Fourth terminals 33 are terminals on the high-speed signal side. Fourth terminals 33 are formed by insert molding. Other terminals (third terminal 32) are assembled inside terminal housing 31 in a bottom-up manner in order to facilitate the assembling. The mounting hole arranged on each fourth terminal 33 can improve the withdrawal force.

In practice, preferably, one end of terminal housing 31 is provided with extension portion 311. Extension portion 311 is provided with an inserting groove for snapping on PCB board 1. The arrangement of extension portion 311 and the inserting groove thereon can embrace the sidewalls of PCB board 1, thereby improving the stability of PCB board 1 and press-fit connector 3 assembled together.

In practice, preferably, first pads 11 are arranged on the side of PCB board 1 in the width direction. Second pads 12 are arranged on the side of PCB board 1 in the length direction. Further, extension portion 311 is provided. As such, the stability of PCB board 1 in the length direction can be further improved.

Since PCB board 1 is partially wrapped by extension 311, the side surface of extension portion 311 can be further provided with arcuate projection 42. A groove passing through extension portion 311 is formed directly under arcuate projection 42. Arcuate groove 411 is provided on snapping-on plate 41. The number of arcuate grooves 411 corresponds to the number of signal transmission assemblies. Thus, snapping-on plate 41 can stably fix a plurality of signal transmission assemblies together through the fitting of the groove, arcuate projection 41, and arcuate groove 411.

Figure 10:
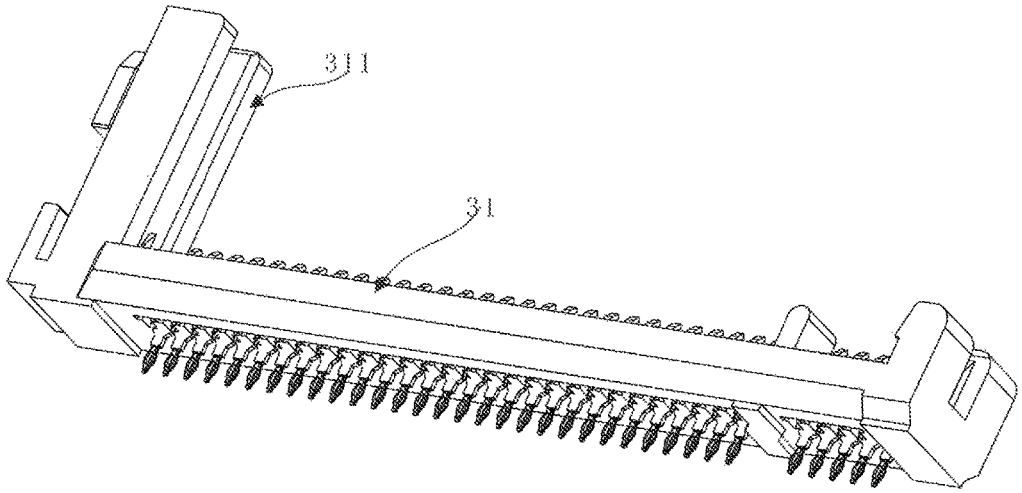
FIG. 10 is a perspective view of a press-fit connector from one perspective.

As shown in FIGS. 10 and 11, terminal housing 31 is provided with at least one convex block 312 in the width direction. The side of PCB board 1 where second pads are located is provided with a groove which fits convex block 312. The arrangement of convex block 312 and the groove can prevent third terminal 32, fourth terminal 33, and second pads 12 from being damaged due to the misalignment of PCB board 1 with respect to press-in connector 3. Thus, the accuracy of the plugging is ensured.

What is claimed is:

1. A fine pitch high density high-speed orthogonal card edge connector, comprising:

at least one signal transmission assembly, a base, wherein, the at least one signal transmission assembly includes a plug-in connector, a press-fit connector, and a PCB board;

a side of the PCB board is provided with a row of first pads;

a side of the PCB board adjacent to the side where the row of first pads is located is provided with a row of second pads;

each first pad corresponds to one second pad one by one through a wiring of the PCB board;

an extension line of each first pad is perpendicular to an extension line of each second pad;

the plug-in connector is mounted on the side of the PCB board provided with the row of first pads and is connected to the plurality of first pads;

the press-fit connector is mounted on the side of the PCB board provided with the row of second pads and is connected to the plurality of second pads;

the base is provided with a plurality of accommodating grooves for mounting the at least one signal transmission assembly;

the number of the plurality of accommodating grooves is the same number as the number of the at least one signal transmission assembly; and each signal transmission assembly is provided with a mounting housing for encapsulating the signal transmission assembly.

2. The fine pitch high density high-speed orthogonal card edge connector of claim 1, wherein, a bar-shaped groove located on each end of the plug-in connector and the press-fit connector is provided with at least one convex rib;

the at least one convex rib contacts both surfaces of the PCB board; and a scrap holding groove is provided under the at least one convex rib.

3. The fine pitch high density high-speed orthogonal card edge connector of claim 1, wherein, the plug-in connector includes a plug-in housing and a terminal assembly;

the terminal assembly is mounted in an assembly snapping-on groove inside the plug-in housing;

the terminal assembly extends out of the assembly snapping-on groove to contact the row of first pads of the PCB board;

the terminal assembly includes two rows of terminals and a connecting plate formed on the two rows of terminals; and the connecting plate is formed by injection molding.

4. The fine pitch high density high-speed orthogonal card edge connector of claim 3, wherein, each row of terminals includes a plurality of first terminals and at least one second terminal;

the at least one second terminal is used for hot-swapping; and the length of the second terminal is greater than the length of the first terminal.

5. The fine pitch high density high-speed orthogonal card edge connector of claim 3, wherein, each of two ends of the assembly snapping-on groove is provided with a projecting portion;

the projecting portion is inclined upward and extends toward a middle portion of the assembly snapping-on groove;

each of two ends of the connecting plate is provided with a snapping-on groove; and the snapping-on groove is configured to fit the projecting portion.

6. The fine pitch high density high-speed orthogonal card edge connector of claim 3, wherein, a positioning key is arranged in a width direction of the connecting plate;

a metal cap is snapped on a lower end of the positioning key;

the side of the PCB board provided with the row of first pads is provided with an arcuate groove; and the arcuate groove is configured to fit the positioning key.

7. The fine pitch high density high-speed orthogonal card edge connector of claim 1, wherein, the press-fit connector includes a terminal housing;

the terminal housing is provided with a bar-shaped mounting groove;

a sidewall of the mounting groove is provided with a row of terminal inserting slots along a length direction;

a plurality of third terminals are snapped in one row of terminal inserting slots;

a plurality of fourth terminals are snapped in another row of terminal inserting slots; and the fourth terminal has a different structure than that of the third terminal.

8. The fine pitch high density high-speed orthogonal card edge connector of claim 7, wherein, each third terminal or each fourth terminal includes a curved portion, a planar connecting plate, and a press-in portion that are connected as a whole;

a width of a portion of the planar connecting plate of the third terminal adjacent to the curved portion is equal to the width of the curved portion;

a width of another portion of the planar connecting plate of the third terminal away from the curved portion is greater than the width of the curved portion;

a width of the planar connecting plate of the fourth terminal is greater than a width of the curved portion; and at least one mounting hole is formed in the planar connecting plate.

9. The fine pitch high density high-speed orthogonal card edge connector of claim 7, wherein, an end of the terminal housing is provided with an extension portion; and the extension portion is provided with an inserting groove for snapping on the PCB board.

10. The fine pitch high density high-speed orthogonal card edge connector of claim 1, wherein, the plug-in connector includes a plug-in housing and a terminal assembly;

the terminal assembly is mounted in an assembly snapping-on groove inside the plug-in housing;

the terminal assembly extends out of the assembly snapping-on groove to contact the row of first pads of the PCB board;

the terminal assembly includes two rows of terminals and a connecting plate formed on the two rows of terminals; and the connecting plate is formed by injection molding.

11. The fine pitch high density high-speed orthogonal card edge connector of claim 2, wherein, the plug-in connector includes a plug-in housing and a terminal assembly;

the terminal assembly is mounted in an assembly snapping-on groove inside the plug-in housing;

the terminal assembly extends out of the assembly snapping-on groove to contact the row of first pads of the PCB board;

the terminal assembly includes two rows of terminals and a connecting plate formed on the two rows of terminals; and the connecting plate is formed by injection molding.

12. The fine pitch high density high-speed orthogonal card edge connector of claim 1, wherein, the press-fit connector includes a terminal housing;

the terminal housing is provided with a bar-shaped mounting groove;

a sidewall of the mounting groove is provided with a row of terminal inserting slots along a length direction;

a plurality of third terminals are snapped in one row of terminal inserting slots;

a plurality of fourth terminals are snapped in another row of terminal inserting slots; and the fourth terminal has a different structure than that of the third terminal.

13. The fine pitch high density high-speed orthogonal card edge connector of claim 2, wherein, the press-fit connector includes a terminal housing;

the terminal housing is provided with a bar-shaped mounting groove;

a sidewall of the mounting groove is provided with a row of terminal inserting slots along a length direction;

a plurality of third terminals are snapped in one row of terminal inserting slots;

a plurality of fourth terminals are snapped in another row of terminal inserting slots; and the fourth terminal has a different structure than that of the third terminal.

* * * * *